US005505304A

United States Patent [19]

Broskow et al.

[11] Patent Number: 5,505,304

[45] Date of Patent: Apr. 9, 1996

[54] WRAPPER AND CARRIER ASSEMBLY AND PACKAGE COMPRISING SAME

[75] Inventors: James A. Broskow, Buffalo Grove; William N. Weaver, Northbrook, both of Ill.

[73] Assignee: Illinois Tool Works Inc., Glenview, Ill.

[21] Appl. No.: 353,067

[22] Filed: Dec. 9, 1994

[51] Int. Cl.[6] ..... B65D 65/00

[52] U.S. Cl. ..... 206/427; 206/150; 206/162; 294/87.2

[58] Field of Search ..... 206/151, 153, 206/158, 150, 162, 199, 427; 294/87.2

[56] References Cited

U.S. PATENT DOCUMENTS

| | | | |
|---|---|---|---|
| 2,446,161 | 7/1948 | Price . | |
| 2,563,065 | 8/1951 | Price . | |
| 2,874,835 | 2/1959 | Poupitch .. | |
| 3,016,136 | 1/1962 | Poupitch . | |
| 3,268,070 | 8/1966 | Cunningham | 206/150 |
| 3,330,408 | 7/1967 | Wanderer | 206/150 |
| 3,684,153 | 8/1972 | Detzel | 206/199 |
| 3,860,112 | 1/1975 | Klygis | 206/151 |

*Primary Examiner*—Bryon P. Gehman
*Attorney, Agent, or Firm*—Dressler, Goldsmith, Shore & Milnamow, Ltd.

[57] ABSTRACT

In a package for substantially identical containers, such as substantially identical bottles, a wrapper is formed from a paperboard sheet, folded, and seamed so as to have a bottom wall and two lateral walls providing expansive surfaces for labelling. Each lateral wall has a longitudinal row of container-receiving apertures, each of which is surrounded completely by portions of such lateral wall. The lateral walls are joined to each other at longitudinally extending folding lines, between the longitudinal rows of container-receiving apertures, so as to define an upper edge of the wrapper. As formed from sheet-form, resilient, polymeric material, a carrier has band segments defining container-receiving apertures in a generally rectangular array, which comprises two longitudinal rows corresponding to the longitudinal rows of container-receiving apertures of the wrapper. The carrier is disposed above the bottom wall of the wrapper, below the upper edge of the wrapper. A handle attached to the carrier extends upwardly from a longitudinal midline of the carrier, into an aperture extending along the upper edge of the wrapper, between the longitudinally extending folding lines.

12 Claims, 4 Drawing Sheets

WRAPPER AND CARRIER ASSEMBLY AND PACKAGE COMPRISING SAME

TECHNICAL FIELD OF THE INVENTION

This invention pertains to an assembly comprising a paperboard wrapper and a sheet-form, polymeric carrier for substantially identical containers, such as beverage bottles, and to a package comprising such containers and such an assembly. The wrapper stabilizes the containers and provides expansive surfaces for pricing, barcoding, and other labelling of the package.

BACKGROUND OF THE INVENTION

Commonly, cans, bottles, or other containers for soft drinks or other beverages are marketed in packages comprising four, six, eight, or twelve containers in machine-applied carriers made from sheet-form, resilient, polymeric material, such as low density polyethylene. The carriers are made, as by die-cutting, so as to have band segments defining container-receiving apertures that are designed to be stretched to receive cans and bottles.

Although such polymeric carriers have many advantages, particularly as compared to predominantly paperboard carriers, such polymeric carriers have some shortcomings. A major shortcoming is that such polymeric carriers do not provide expansive surfaces for pricing, barcoding, or other labelling of the packages.

As exemplified in Poupitch U.S. Pat. No. 2,874,835 and Poupitch U.S. Pat. No. 3,016,136, it has been known to employ separate wire or other handles with such polymeric carriers. Although handles as known heretofore are useful with such polymeric carriers, such known handles do not provide suitable labelling surfaces.

An improved carrier made from sheet-form, resilient, polymeric material, such as low density polyethylene, and having an upwardly extending handle portion made from similar polymeric material is disclosed in Broskow U.S. patent application Ser. No. 08/230,308 filed Apr. 20, 1994, and assigned commonly herewith. In the improved carrier disclosed therein, neither the carrier nor the handle provides suitable labelling surfaces.

Bottle carriers of related interest can be also made from folded sheet material without employing resilient carriers, as exemplified in Price U.S. Pat. Nos. 2,446,161 and 2,563,065.

This invention has resulted from efforts to provide an improved package for bottles or other containers for soft drinks or other beverages.

SUMMARY OF THE INVENTION

This invention provides a novel assembly for wrapping partially and carrying two longitudinal rows of substantially identical containers, such as substantially identical bottles for soft drinks or other beverages. The novel assembly comprises a wrapper formed from a paperboard sheet and a carrier formed from sheet-form, resilient, polymeric material. The novel assembly may include a handle attached to the carrier. The wrapper stabilizes the containers being carried and provides expansive surfaces for pricing, barcoding, and other labelling. The wrapper and carrier are designed to minimize material and to provide for easy bottle removal.

The wrapper is formed, folded, and seamed so as to have a bottom wall and two lateral walls providing expansive surfaces for labelling. Each lateral wall has a longitudinal row of container-receiving apertures, each of which is surrounded completely by portions of such lateral wall. The lateral walls are joined to each other between the longitudinal rows of container-receiving apertures, so as to define an upper edge of the wrapper.

The carrier is formed so as to have band segments defining container-receiving apertures in a generally rectangular array, which comprises two longitudinal rows corresponding to the longitudinal rows of container-receiving apertures of the wrapper. The carrier is disposed above the bottom wall of the wrapper, below the upper edge of the wrapper. If a handle is attached to the carrier, the handle extends upwardly from a longitudinal midline of the carrier, into an aperture extending along an upper edge of the wrapper.

Preferably, in the wrapper, the lateral walls are joined along at least one longitudinally extending folding line in the wrapper so as to define the upper edge of the wrapper. More preferably, the lateral walls are joined along two longitudinally extending, longitudinally spaced folding lines in the wrapper so as to define the upper edge of the wrapper, and the wrapper has a longitudinally extending aperture between the longitudinally spaced folding lines. If a handle is attached to the carrier, the handle may extend into this aperture. Portions of the lateral walls may be adhesively secured so as to provide a double thickness of the paperboard sheet along the upper edge of the wrapper.

In one contemplated embodiment, the wrapper is formed, folded, and seamed so as to have two end flaps joined to each lateral wall at the opposite ends of such lateral wall, the end flaps being secured adhesively to each other at each of the opposite ends of the lateral walls. In another contemplated embodiment, the wrapper is formed, folded, and seamed so as to have gussets at the opposite ends of each lateral wall where such lateral wall is joined to the bottom wall.

Preferably, the containers are gripped loosely by the band segments defining the container-receiving apertures to facilitate removal of each container from the package, whereas the bottom wall of the wrapper is disposed to prevent the containers from dropping through the carrier.

In a package combining the wrapper and carrier assembly described above with substantially identical containers in a number equal to the number of container-receiving apertures of the wrapper, each container being received by one of the container-receiving aperture and each container having a midpoint between an upper end of said container and a lower end of said container, it is preferable for each container-receiving aperture to be oblong with an upper edge substantially above the midpoint of the container received by said container-receiving aperture and with a lower edge substantially below the midpoint of the container received by said container-receiving aperture. Moreover, it is preferable for the carrier to be disposed between the upper and lower edges of the container-receiving apertures.

The carrier and wrapper combination described herein creates a stable package and provides for easy removal of each container without disturbing the stability of the remaining containers.

These and other objects, features, and advantages of this invention are evident from the following description of presently contemplated embodiments of this invention with reference to the accompanying drawings.

DETAILED DESCRIPTION OF THE ILLUSTRATED EMBODIMENTS

Figure 1:
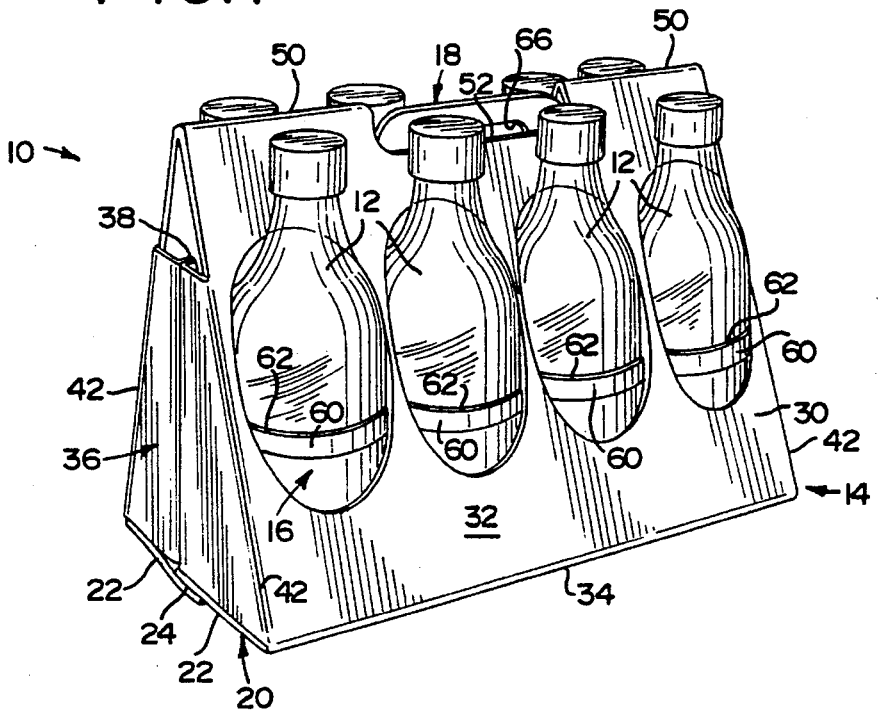
FIG. 1 is a perspective view of a first package embodying this invention and comprising eight substantially identical bottles, a paperboard wrapper, a polymeric carrier, and a polymeric handle.
Figure 2:
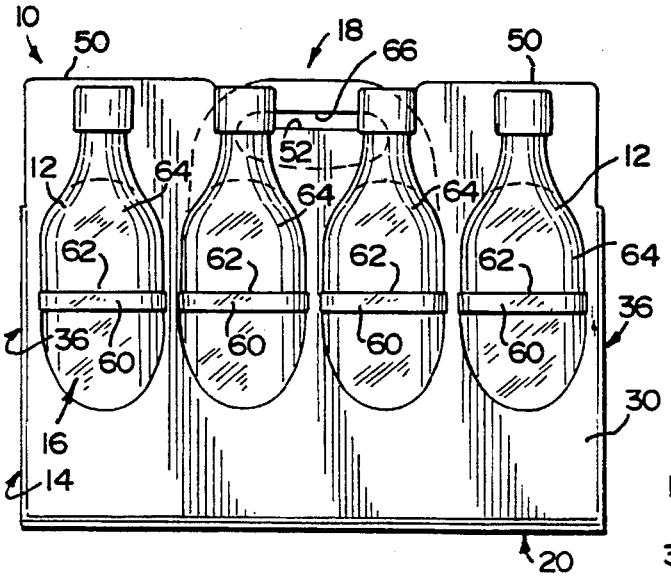
FIG. 2 is an elevational view of one side of the first package.
Figure 3:
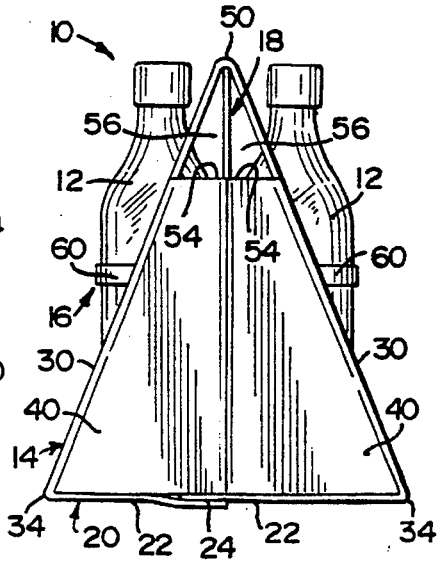
FIG. 3 is an elevational view of one end of the first package.

As shown in FIGS. 1, 2, and 3, a package 10 comprising eight substantially identical containers 12, a paperboard wrapper 14, a polymeric carrier 16, and a polymeric handle 18 constitutes a first embodiment of this invention. As shown, the containers 12 are bottles, which may contain soft drinks or other beverages. Alternatively, the containers 12 may be beverage cans (not shown) or other containers. The containers 12 are arranged in a generally rectangular array, which comprises two longitudinal rows and four transverse ranks, namely two endmost ranks and two intermediate ranks. The wrapper 14, the carrier 16, and the handle 18 provide an assembly for wrapping partially and carrying the containers 12. The wrapper 14 stabilizes the containers 12 being carried and provides expansive surfaces for pricing, barcoding, and other labelling.

Figure 4:
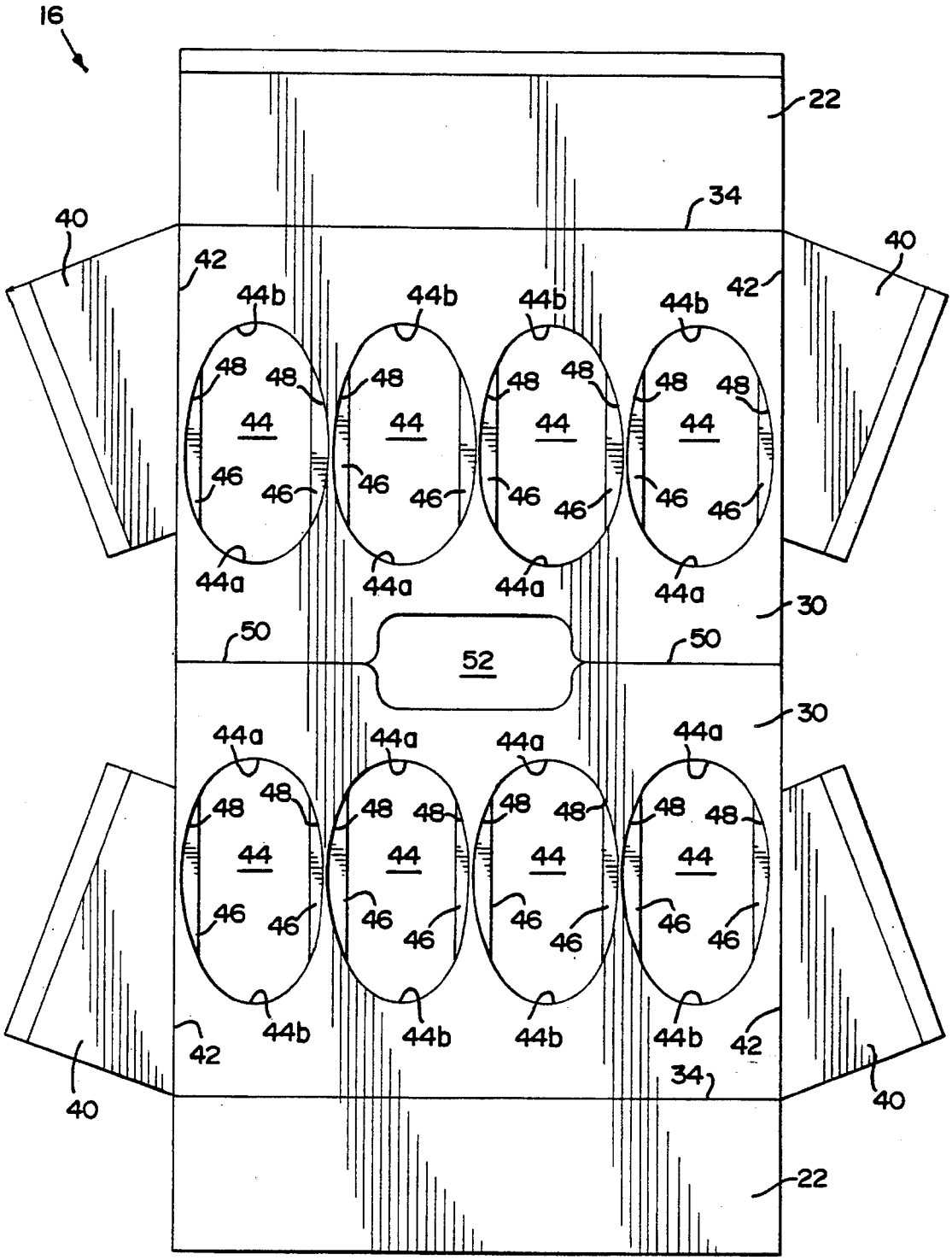
FIG. 4 is a plan view of a paperboard blank, which is formed from a paperboard sheet, as by die-cutting, and from which the wrapper of the first package is made by folding and seaming.

The wrapper 14 is formed from a paperboard sheet, as by die-cutting, so as to form a paperboard blank 16. As shown in FIG. 4, the paperboard blank 16 has various folding lines, which may be scored. The wrapper 14 is formed, folded, and seamed so as to have a bottom wall 20 comprising two separate panels 22 joined at a longitudinally extending, overlapped seam 24 utilizing a suitable adhesive, two similar, lateral walls 30 providing expansive labelling surfaces 32 and joined to the bottom wall 20 at longitudinally extending folding lines 34, and two end walls 36. Each lateral wall 30 has two end flaps 40, each of which is joined to such lateral wall 30 at an upwardly and inwardly inclined folding line 42. At each of the opposite ends of the lateral walls 30, the end flaps 40 of the respective walls 30 are joined to each other at a vertically extending seam 38, so as to form one of the end walls 36.

Each lateral wall 30 has a longitudinal row of container-receiving apertures 44, each of which is surrounded completely by portions of such lateral wall 30. At each aperture 44, such portions include two longitudinally opposed lips 46, which are intended to be downwardly bent when a container 12 is received by such aperture so as to provide a wedging force on the container 12 received thereby. The lips 46 may be partly cut away from adjacent portions of the lateral walls 30, along curved lines 48 shown in FIG. 4, so as to permit the lips 46 to be downwardly bent without tearing.

The apertures 44 are generally oblong such that each aperture 44 is elongated vertically in the finished package 10, and such that each aperture 44 includes a curved upper edge **44*a* that is spaced from a curved lower edge 44*b* in the finished package 10. Each container 12 has a midpoint spaced equally from the upper end of such container 12 and its lower end. The upper edges 44*a* of the apertures 44 are positioned substantially above the midpoints of the containers 12 and the lower edges 44*b* of the apertures 44 are positioned substantially below the midpoints of the containers 12. The apertures 44 are designed to cooperate with the carrier 16 so that the edges of the apertures 44 contain and contact the containers 12 at and between two levels of the containers 12. The lower edges 44*b* cooperate with the folding lines 34 to create relatively low height portions of the walls 30, which portions contribute to the stability of the package 10 and permit some advertising and labelling space on the surfaces 32, while minimizing the material used in the package 10**.

As shown in FIGS. 1, 2, and 3, the lateral walls 30 are joined to each other, along two longitudinally extending, longitudinally spaced folding lines 50, so as to define an upper edge of the wrapper 14. The wrapper 14 has a longitudinally extending aperture 52 between the longitudinally extending folding lines 50. As shown in FIG. 3, the end walls 36 have upper edges 54, which are spaced below the folding lines 40 so as to define generally triangular openings 56 above the end walls 36. Moreover, the lateral walls 30 are planar and extend linearly from the upper edge defined by the folding lines 50, outwardly and downwardly toward the bottom wall 20.

The carrier 16 is formed from sheet-form, resilient, polymeric material, such as low density polyethylene, so as to have band segments 60 defining container-receiving apertures 62 in a generally rectangular array, which corresponds to the generally rectangular array of the containers 12. The carrier 16 has a longitudinal midline between the longitudinal rows of container receiving apertures 62. Each container 12 is received by one such aperture 62 so that the band segments 60 defining the same aperture 62 grip the side wall 64 of such container 12. The handle 18 is formed from similar polymeric material and is attached to the carrier 16, at a thermoplastic seam (not shown) extending along the longitudinal midline of the carrier 16, so as to extend upwardly from such midline, above the containers 12. An upper portion of the handle 18 has an elongate aperture 66, which can accommodate two or three fingers of one hand of a user, so as to facilitate lifting the package via the handle 18. As shown, the carrier 16 is disposed below the folding lines 50 at the upper edge of the wrapper 14. Moreover, the upper portion of the handle 18 extends upwardly into the aperture 52 at the upper edge of the wrapper 14.

Preferably, the carrier 16 and the handle 18 are similar to the previously noted, improved carrier, which has a handle portion, as disclosed in U.S. patent application Ser. No. 08/230,308, supra, the disclosure of which is incorporated herein by reference.

Preferably, the containers 12 are gripped loosely by the band segments 60 defining the container-receiving apertures 62, so as to permit the containers 12 to be easily removed from the package 10. Typical band-type carriers are stretched 25% to 35%, but the carrier 16 is similar to the carrier illustrated and described in Van Erden U.S. Pat. No. 5,154,289 in being stretched less than 10%. However, the bottom wall 20 of the wrapper 14 is disposed wholly beneath the containers 12, so as to prevent the containers 12 from dropping through the carrier 16. Moreover, because of the tightness created by the overall package 10, the carrier 16 remains with wrapper 14 as the containers 112 are removed.

The edges of the container-receiving apertures 44 contribute to the stability of the package 10 by engaging the containers 12 and by preventing the containers 12 from tipping inwardly. Moreover, the apertures are located so as to separate the containers 12 in each longitudinal row from the containers 12 in the other longitudinal row, thereby to exert a slight stretching force on the resilient carrier 16. This stretching force contributes greatly to the stability, unitization, and feel of the package 10.

Figure 5:
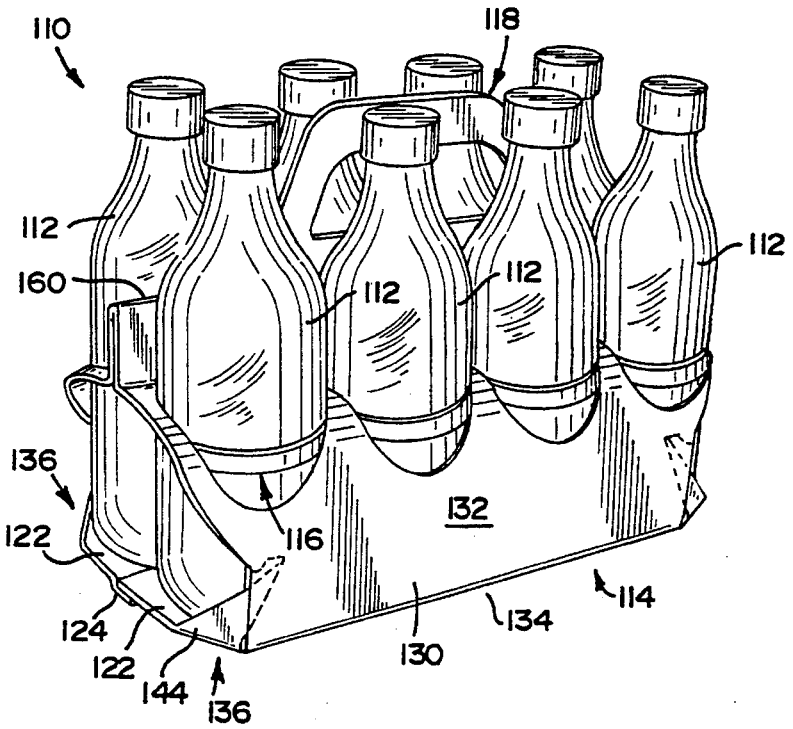
FIG. 5 is a perspective view of a second package embodying this invention and comprising eight substantially identical bottles, a paperboard wrapper, a polymeric carrier, and a polymeric handle.
Figure 6:
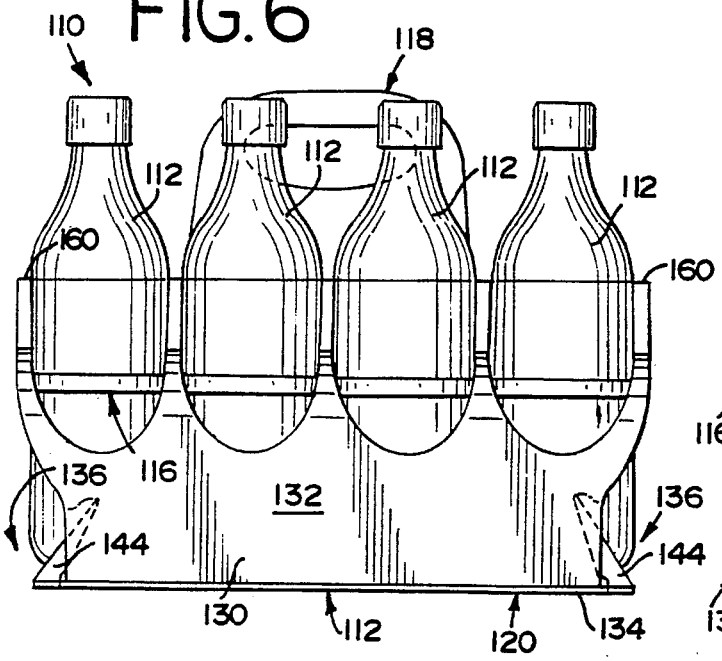
FIG. 6 is an elevational view of one side of the second package.
Figure 7:
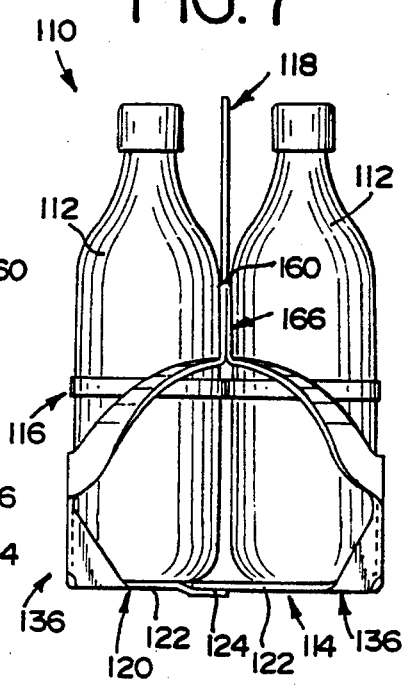
FIG. 7 is an elevational view of one end of the second package.

As shown in FIGS. 5, 6, and 7, a package 110 comprising eight substantially identical containers 112, a paperboard wrapper 114, a polymeric carrier 116, and a polymeric handle 118 constitutes a second embodiment of this invention. The package 110 is similar to the package 10, except that the paperboard wrapper 114 differs from the paperboard wrapper 14 in some respects, as described below.

Figure 8:
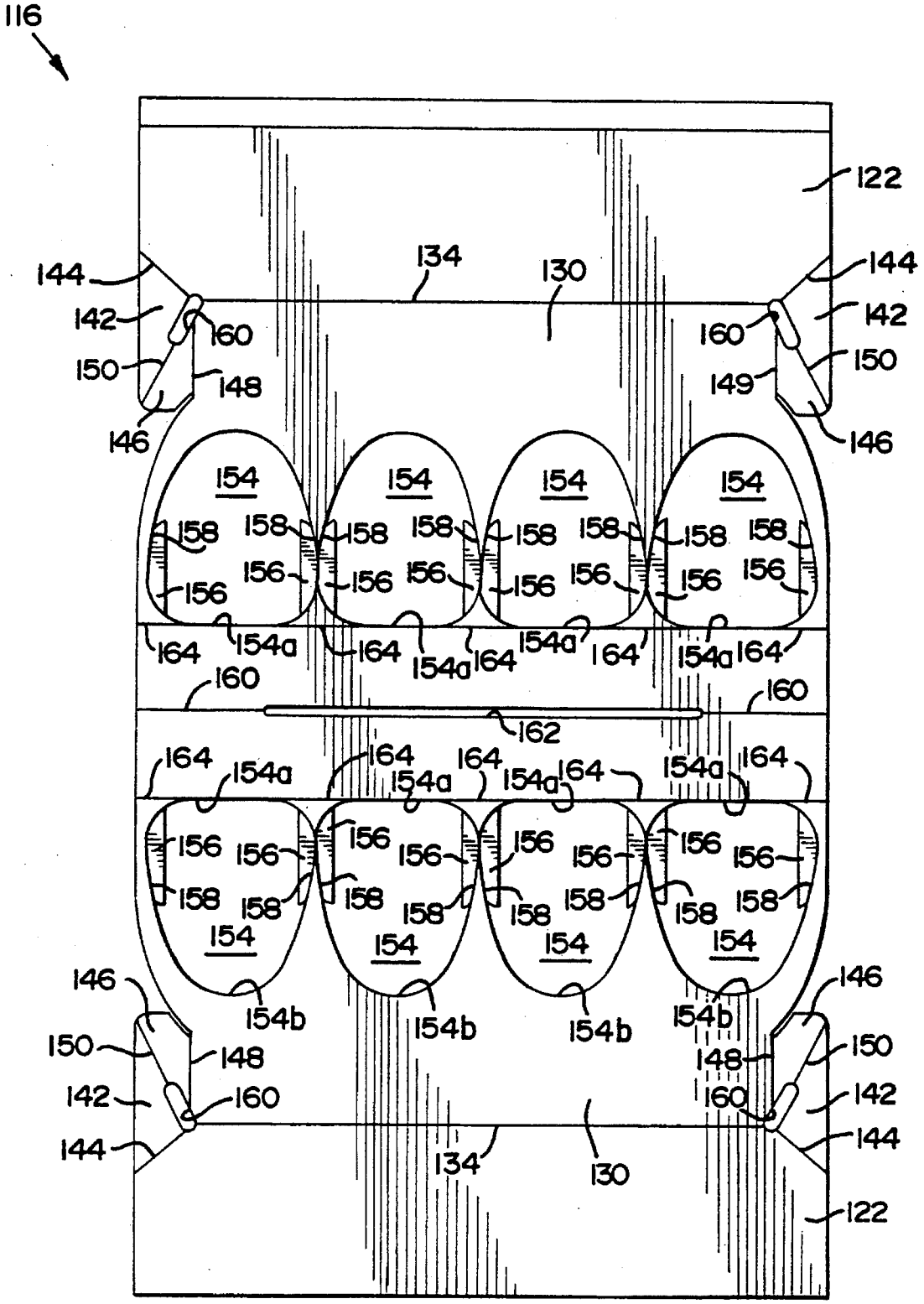
FIG. 8 is a plan view of a paperboard blank, which is formed from a paperboard sheet, as by die-cutting, and from which the wrapper of the second package is made by folding and seaming.

The wrapper 114 is formed from a paperboard sheet, as by die-cutting, so as to form a paperboard blank 116. As shown in FIG. 8, the paperboard blank 116 has various folding lines, which may be scored. The wrapper 114 is formed, folded, and seamed so as to have a bottom wall 120 comprising two separate panels 122 joined at a longitudinally extending, overlapped seam 122 utilizing a suitable adhesive, two similar, lateral walls 130 providing expansive labelling surfaces 132 and joined to the bottom panels 122 at longitudinally extending folding lines 134, and gussets 136 at the opposite ends of each lateral wall 130 where such lateral wall 130 meets the bottom panel 122 joined to such lateral wall 130.

Each gusset 136 is formed by a small panel 142, which is joined to an adjacent one of the bottom panels 122 at a folding line 144 defining an acute angle relative to the nearer folding line 134, and by a small panel 146, which is joined to an adjacent one of the lateral walls 130 at a folding line 148 defining a right angle relative to the nearer folding line 134, and which is joined to the panel 142 of such gusset 136 at a folding line 150 defining an obtuse angle relative to the folding line 144 of such gusset 136 and defining an acute angle relative to the folding line 148 of such gusset 136. Each gusset 136 has an elongate aperture 160 extending from and aligned with the folding line 146 so as to facilitate folding of such gusset 136.

Each gusset 136 is folded along the folding lines 144, 148, 150, so that the panel 146 is folded inwardly against the adjacent one of the lateral walls 130, so that the panel 142 extends upwardly and inwardly from the adjacent one of the bottom panels 122, and so that a portion of the panel 142 is disposed against the panel 146. The panel 142 may be adhesively secured to the panel 146 where a portion of the panel 142 is disposed against the panel 146.

Each lateral wall 130 has a longitudinal row of container-receiving apertures 154, each of which is surrounded completely by portions of such lateral wall 130. At each aperture 154, such portions include two longitudinally opposed lips 156, which are intended to be downwardly bent when a container 112 is received by such aperture so as to provide a wedging force on the container 112 received thereby. The lips 156 may be partly cut away from adjacent portions of the lateral walls 130, along curved lines 158 shown in FIG. 8, so as to permit the lips 156 to be downwardly bent without tearing.

The apertures 154 are generally oblong such that each aperture 154 is elongated vertically in the finished package 110, and such that each aperture 154 includes a straight upper edge **154*a* that is spaced from a curved lower edge 154*b* in the finished package 110. Each container 112 has a midpoint spaced equally from the upper end of such container 112 and its lower end. The upper edges 154*a* of the apertures 154 are positioned substantially above the midpoints of the containers 112 and the lower edges 154*b* of the apertures 154 are positioned substantially below the midpoints of the containers 112. The apertures 154 are designed to cooperate with the carrier 116 so that the edges of the apertures 154 contain and contact the containers 112 at and between two levels of the containers 112. The lower edges 154*b* cooperate with the folding lines 34 to create relatively low height portions of the walls 30, which portions contribute to the stability of the package 110 and permit some advertising and labelling space on the surfaces 32, while minimizing the material used in the package 110**.

As shown in FIGS. 5, 6, and 7, the lateral walls 130 are joined to each other, along two longitudinally extending, longitudinally spaced folding lines 160, so as to define an upper edge of the wrapper 114. The wrapper 114 has a longitudinally extending aperture 162 between the longitudinally extending folding lines 160. The lateral walls 130 are folded along longitudinally extending folding lines 164 bordering the container-receiving apertures 154 and being aligned with the straight upper edges **154*a*, so as to form double thicknesses of the paperboard material of the wrapper 114 between the folding lines 160 and the folding lines 164. At such double thicknesses, except below the longitudinally extending aperture 162, the lateral walls 130 are adhesively secured to each other so as to form a beam structure 166. Below such double thicknesses, as shown in FIG. 7, the lateral walls 130 are bowed so as to be slightly convex and extend curvilinearly but downwardly and outwardly toward the bottom wall 120**.

As shown, the carrier 116 is disposed below the folding lines 164 bordering the container-receiving apertures 154, and the upper portion of the handle 118 extends upwardly through the aperture 162 at the upper edge of the wrapper 114. Because of the beam structure 166, and because of the tightness created by the overall package 110, the carrier 116 remains with wrapper 114 as the containers 112 are removed.

In each embodiment, as described above, the containers of a given number (e.g., eight, as shown) are supported individually in an equal number of container-receiving apertures of the paperboard wrapper. Moreover, in each embodiment, the paperboard wrapper and the polymeric carrier are combined advantageously to minimize the amount of paperboard material used and also to minimize the amount of polymeric material used. Each embodiment is designed so that the polymeric carrier remains with the paperboard wrapper, as the containers are removed, so that disposition of the polymeric and paperboard materials is facilitated.

Various modifications may be made in the preferred embodiment described above without departing from the scope and spirit of this invention.

We claim:

1. A wrapper and carrier assembly for wrapping partially and carrying two longitudinal rows of substantially identical containers, as a package, the assembly comprising (a) a wrapper formed from a paperboard sheet, folded, and seamed so as to have a bottom wall and two lateral walls providing expansive surfaces for labelling, each lateral wall having two opposite ends and having a longitudinal row of container-receiving apertures, each of which apertures is surrounded completely by portions of said lateral wall, the lateral walls being joined to each other between the longitudinal rows of container-receiving apertures, so as to define an upper edge of the wrapper where the lateral walls are joined to each other, and (b) a carrier formed from sheet-form, resilient, polymeric material so as to have band segments defining container-receiving apertures in a generally rectangular array, which comprises two longitudinal rows corresponding to the longitudinal rows of container-receiving apertures of the wrapper, the carrier being disposed above the bottom wall of the wrapper, below the upper edge defined where the lateral walls are joined to each other.

2. The wrapper and carrier assembly of claim 1 wherein the lateral walls are joined along at least one longitudinally extending folding line in the wrapper so as to define the upper edge of the wrapper.

3. The wrapper and carrier assembly of claim 2 wherein portions of the wrapper are secured adhesively so as to provide a double thickness of the paperboard sheet along the upper edge of the wrapper.

4. The wrapper and carrier assembly of claim 1 wherein the lateral walls are joined along two longitudinally extending, longitudinally spaced folding lines in the wrapper so as to define the upper edge of the wrapper, the wrapper having a longitudinally extending aperture between the longitudinally spaced folding lines.

5. The wrapper and carrier assembly of claim 4 wherein portions of the wrapper are secured adhesively so as to provide a double thickness of the paperboard sheet along the upper edge of the wrapper.

6. The wrapper and carrier assembly of claim 4 wherein the wrapper is formed, folded, and seamed so as to have two end flaps joined to each lateral wall at the opposite ends of said lateral wall, the end flaps being secured adhesively to each other at each of the opposite ends of the lateral walls.

7. The wrapper and carrier assembly of claim 4 wherein the wrapper is formed, folded, and seamed so as to have gussets at the opposite ends of each lateral wall where said lateral wall is joined to the bottom wall.

8. The wrapper and carrier assembly of claim 1 further comprising a handle attached to the carrier, the handle extending upwardly from a longitudinal midline of the carrier, into an aperture extending along the upper edge of the wrapper.

9. The wrapper and carrier handle assembly of claim 8 wherein the handle extends substantially above the upper edge of the wrapper.

10. The wrapper and carrier assembly of claim 4 further comprising a handle attached to the carrier, the handle extending upwardly from a longitudinal midline of the carrier, into the longitudinally extending aperture.

11. The wrapper and carrier handle assembly of claim 10 wherein the handle extends substantially above the upper edge of the wrapper.

12. The wrapper and carrier assembly of claim 1 combined with substantially identical containers in a number equal to the number of container-receiving apertures of the wrapper, each container being received by one of the container-receiving apertures, each container having a midpoint spaced approximately at equal distances between an upper end of said container and a lower end of said container, each container-receiving aperture being oblong with an upper edge substantially above the midpoint of the container received by said container-receiving aperture and with a lower edge substantially below the midpoint of the container received by said container-receiving aperture, the carrier being disposed between the upper and lower edges of the container-receiving apertures.

* * * * *